US009884239B2

(12) United States Patent
Kay et al.

(10) Patent No.: US 9,884,239 B2
(45) Date of Patent: Feb. 6, 2018

(54) PORTABLE, EXTENSIBLE, EXERCISE WEIGHT SUPPORT DEVICE WITH SAFETY FEATURES

(71) Applicants: John Gordon Kay, Avon Lake, OH (US); Thomas John Slomka, Cleveland, OH (US); David Gilchrist Kay, White Bear Lake, MN (US); John Emerson Pine, Lagrange, OH (US)

(72) Inventors: John Gordon Kay, Avon Lake, OH (US); Thomas John Slomka, Cleveland, OH (US); David Gilchrist Kay, White Bear Lake, MN (US); John Emerson Pine, Lagrange, OH (US)

( * ) Notice: Subject to any disclaimer, the term of this patent is extended or adjusted under 35 U.S.C. 154(b) by 81 days.

(21) Appl. No.: 14/998,980

(22) Filed: Mar. 11, 2016

(65) Prior Publication Data

US 2016/0263461 A1 Sep. 15, 2016

Related U.S. Application Data

(60) Provisional application No. 62/133,418, filed on Mar. 15, 2015.

(51) Int. Cl.

| | |
|---|---|
| ***A63B 21/00*** | (2006.01) |
| ***A63B 71/00*** | (2006.01) |
| ***A63B 21/078*** | (2006.01) |
| ***A63B 24/00*** | (2006.01) |
| *A63B 21/072* | (2006.01) |
| *A63B 71/06* | (2006.01) |
| *A63B 21/005* | (2006.01) |

(Continued)

(52) U.S. Cl.

CPC ..... *A63B 71/0054* (2013.01); *A63B 21/0783* (2015.10); *A63B 21/153* (2013.01); *A63B 24/0087* (2013.01); *A63B 7/00* (2013.01); *A63B 21/0058* (2013.01); *A63B 21/00181* (2013.01); *A63B 21/0724* (2013.01); *A63B 21/0726* (2013.01); *A63B 21/157* (2013.01); *A63B 23/1209* (2013.01); *A63B 71/0622* (2013.01); *A63B 2023/0411* (2013.01); *A63B 2209/02* (2013.01); *A63B 2220/13* (2013.01)

(58) Field of Classification Search

None

See application file for complete search history.

(56) References Cited

U.S. PATENT DOCUMENTS

| | | | | |
|---|---|---|---|---|
| 4,216,959 | A | 8/1980 | Niles | 272/123 |
| 4,306,715 | A | 12/1981 | Sutherland | 272/117 |

(Continued)

*Primary Examiner* — Stephen R Crow

(74) *Attorney, Agent, or Firm* — David A. Burge

(57) ABSTRACT

An exercise weight support device includes a retractable belt with an upper end for attachment to a ceiling or other overhanging support structure to enable suspension therefrom of the exercise weight support device, a cradle and/or one or more hooks to enable the weight support device to be used to suspend a free weight from the ceiling or other overhanging support structure, a retracting reel mechanism attached to the lower end of the belt to selectively retract or pay out the belt to selectively enable vertical movement of the free weight to a desired height, and a trigger handle co-located with the retracting reel mechanism and operable to selectively disallow lowering of the free weight when the trigger handle is not continuously operated by a lifter performing a lifting exercise.

20 Claims, 9 Drawing Sheets

(51) Int. Cl.

| | |
|---|---|
| *A63B 23/12* | (2006.01) |
| *A63B 23/04* | (2006.01) |
| *A63B 7/00* | (2006.01) |

(56) References Cited

U.S. PATENT DOCUMENTS

| | | | | |
|---|---|---|---|---|
| 4,709,922 | A | 12/1987 | Slade, Jr. et al. | 272/123 |
| 4,998,721 | A | 3/1991 | Anders et al. | 272/118 |
| 4,998,723 | A | 3/1991 | Santoro | 272/117 |
| 5,048,826 | A | 9/1991 | Ryan | 272/123 |
| 5,310,394 | A | 5/1994 | Kallios | 482/104 |
| 5,716,306 | A | 2/1998 | Gallay | 482/104 |
| 5,823,921 | A | 10/1998 | Dawson | 482/104 |
| 5,989,164 | A | 11/1999 | Kullman et al. | 482/93 |
| 6,293,892 | B1 | 9/2001 | Slawinski et al. | 482/104 |
| 6,379,287 | B1 | 4/2002 | Slawinski et al. | 482/104 |
| 6,537,182 | B2 | 3/2003 | Salwinski et al. | 482/104 |
| 6,669,607 | B2 | 12/2003 | Salwinski et al. | 482/104 |
| 6,715,728 | B2 * | 4/2004 | Nielsen | A63B 21/4009 224/268 |
| 6,893,381 | B2 | 5/2005 | Salwinski | 482/8 |
| 6,926,649 | B2 | 8/2005 | Salwinski | 482/104 |
| 7,374,515 | B2 | 5/2008 | Salwinski et al. | 482/104 |
| 7,503,736 | B1 * | 3/2009 | Chen | B60P 7/083 410/100 |
| 7,819,785 | B2 | 10/2010 | Maiaro et al. | 482/104 |
| 8,444,537 | B1 | 5/2013 | Santoro | 482/104 |
| 8,517,900 | B1 | 8/2013 | Britt | 482/104 |
| 8,784,281 | B2 | 7/2014 | Johnson, III | 482/104 |
| 2007/0179030 | A1 | 8/2007 | Slawinski | 482/98 |
| 2012/0157271 | A1 | 7/2012 | Bauer | 482/104 |
| 2012/0244999 | A1 | 9/2012 | Tauriainen | 482/104 |
| 2013/0190143 | A1 | 7/2013 | Greenhill et al. | 482/104 |
| 2014/0073493 | A1 * | 3/2014 | Parish | A63B 21/0724 482/104 |

* cited by examiner

PORTABLE, EXTENSIBLE, EXERCISE WEIGHT SUPPORT DEVICE WITH SAFETY FEATURES

REFERENCE TO PROVISIONAL APPLICATION

This Utility application claims the benefit of the filing date of Provisional Application Ser. No. 62/133,418 filed Mar. 15, 2015 by John Gordon Kay et al, the disclosure of which is incorporated herein by reference.

BACKGROUND

The present invention relates to the field of exercise devices—specifically to devices that protect a weight lifter when lifting free weights such as a barbell or a pair of dumbbells when assistance from a human spotter is unavailable.

Weightlifting is enjoyed by millions of people in pursuit of better health and increased strength. Lifting free weights, such as barbells or a pair of dumbbells that are unconnected to any stationary structure, is widely regarded as a better form of weightlifting than using a weightlifting machine, because the lifter is free to use their normal range of movement for their body type when lifting. However, lifting free weights presents a greater variety of risks for personal injury to both the lifter and to others who may be in the vicinity of the lifter than does using a weightlifting machine. The variety of possible risks in lifting with free weights includes a greater variety of types of muscle strain involving a greater variety of muscles, as well as the possibility of dropping a barbell on a part of the lifter's body, including the neck.

It is this greater variety of risks that long ago led to the introduction of an ever increasing variety of weightlifting machines. Generally, weightlifting machines increase safety by limiting the range of possible movement made by the lifter during the lifting exercise to little more than a single straight or gently arcing movement. This greatly simplifies the lifting exercise by relieving the lifter of having to exert additional energy to constrain the movement of weights in directions other than along the path of movement that is intended during the lifting exercise. Also, weightlifting machines generally eliminate the need for a lifter to initially lift weights from a rack or floor to a starting position from which the lifting exercise is to begin in a so-called "pre-lift" phase occurring prior to the intended lifting exercise, itself, during a so-called "lifting" phase. Also generally eliminated is the need for the lifter to lower weights back down to the rack or floor after the lifting exercise in a so-called "post-lift" phase occurring after the lifting phase. Many lifters find the exertion required during the pre-lift and post-lift phases can actually be greater than the exertion that occurs during the lifting exercise, itself, in the lifting phase. By eliminating the pre-lift and post-lift phases, weightlifting machines can preclude any occurrences of accidents during those phases. It is for these reasons that weightlifting machines are often viewed as a good option for novice weightlifters and/or individuals who only occasionally lift weights.

Unfortunately, while the imposition of such limits in movement by weightlifting machines may greatly increase safety, and while the elimination of the pre-lift and post-lift phases by weightlifting machines may be seen as positive benefits that even avid lifters may appreciate, those same imposed limits in movement are seen as having disadvantages. Among the disadvantages are that removing the need for additional exertion by a lifter to constrain the movement of weights in directions other than along the path of movement can remove the opportunity to develop other muscles than those strictly required to exert weightlifting force along that constrained path of movement. In other words, muscle development may become limited to only particular muscles such that some muscles in a part of the body may become markedly more developed than other muscles in that same part of the body. It is this possible result that often causes avid lifters to choose free weights over weightlifting machines, and thereby accept the increased potential for accidents and injury.

An example of one free weight upper body pressing exercise is the flat-bench dumbbell press. First, after retrieving a pair of dumbbells from a rack or the floor, the lifter begins the pre-lift phase while sitting on a bench with a pair of dumbbells, one in each hand and resting one atop each knee. The lifter then uses their leg strength in combination with their arm and shoulder strength to bounce up the dumbbells with their knees and raise the dumbbells with their hands into the air as the lifter falls backwards onto the bench.

Second, in the lifting phase, the lifter performs repetitions (reps) of the lifting exercise, itself, which entails moving the dumbbells repeatedly between an upper position elevated well above the level of the chest and a lower position that is usually at about the level of the chest. The lower position varies to some degree among lifters, however it is critical to avoid too low or deep a movement, which can lead to possible injury to the shoulder joint and surrounding muscles.

Third is the post-lift phase, which usually begins after the lifter has either performed the desired number of reps or is unable to lift the dumbbells back to the upper position to perform any more reps. If the lifter is able to lift the dumbbells again to the upper position, then the lifter may perform a reversal of the pre-lift phase during the post-lift phase, and then returns the dumbbells safely to the storage rack or floor. However, if the lifter is unable to lift the dumbbells again to the upper position then the lifter is in a potentially precarious position and must find a safe way to return the dumbbells back to either the rack or to the floor. If lifter attempts to lower the dumbbells to the floor, then they risk the aforementioned damage to their shoulder joints. If the lifter chooses to drop the dumbbells to the floor, then they risk potential injury to bystanders or themselves and/or damage to equipment, personal property and even the floor, itself.

An example of a free weight lower body exercise is the standard squat or "squat." The pre-lift phase typically entails removing a weighted barbell from hooks or catches of a cage or rack structure that supports the barbell at close to an upper position of the reps of the exercise during the lift phase. Correspondingly, the post-lift phase typically entails returning the barbell to being supported by those hooks or catches. The cage or rack structure may also provide stops set at position that is slightly below the lower position that the lifter is to lower the barbell to before returning to the upper position in each rep. The vertical position of the hooks or catches that serve to support the barbell near the upper position before and after the exercise, and the vertical position of the stops that are able to support the barbell near the lower position should be adjustable to fit the individual needs of the lifter.

During the pre-lift phase, the lifter centers themselves under the barbell while it is supported by the hooks or catches which may be set at a vertical position just below the level of the lifter's shoulders. The lifter then engages the barbell, resting it behind them and upon their lower neck/upper back while gripping the barbell with both hands just outside of their shoulders or wider. The lifter then lifts the weighted barbell off of the hooks or catches and takes one or two steps backward so that the supports do not hinder the vertical travel of the barbell between the lower and upper positions during the lift phase. The lifter then places their feet at or near shoulder width in a position that will not change during performance of the reps of the exercise, and that will provide balance and stability throughout those reps. The lifting phase begins when the lifter, while keeping their back straight or slightly arched, bends their knee joints to lower the barbell to the lower position at which their upper leg reaches an angle that is parallel or below parallel to the floor. The lifter then straightens their knees to lift the barbell back to the upper position, thereby completing one rep.

Once the desired number of reps is completed, the post-lift phase begins with the lifter taking a step or two forward to move the barbell back towards the hooks or catches onto which the lifter lowers the barbell. The lifter may then step out from under the barbell, thereby concluding the exercise. There is potential for the lifter to incur injury during any of the three phases, such as a sore neck or paralysis. If, during any of the three phases, the lifter feels a need to get the barbell off of their back immediately, the only way to achieve this is for the lifter to release their grip on the barbell, let it roll out of their hands and off their shoulders backwards, and let it fall down onto the floor. This presents the possibility of injury to the lifter and/or bystanders, as well as damage to the cage or rack, damage to the floor and/or damage to the barbell, itself.

Various efforts have been made by others to address the potential for injury and/or damage to property that may arise during weightlifting with free weights. Disclosed in U.S. Pat. No. 4,306,715 issued to Sutherland is a barbell storage and exercise rack with a pair of cradles to support a barbell near the upper position and a pair of safety side rails to prevent the barbell from inadvertently falling on the user. However, this device addresses safety concerns only during the start and end of each rep of the squat movement during the lifting phase.

Disclosed in U.S. Pat. Pub. No. 2012/0157271 filed by Bauer is a dumbbell support rack to ease the beginning an exercise with a dumbbell, and to secure the dumbbell after an exercise has been performed. However, this device focuses only on the upper position at the start and end of each rep of a dumbbell press exercise, and provides no other assistance during any other part of the lifting phase. Also, the assistance at the end of each rep is only available if the lifter is able to lift the dumbbell back up to the upper position where it can be deposited into the dumbbell support rack. Otherwise, if the lifter is not able to lift the dumbbell back up to the upper position, then the lifter must still drop or lower the dumbbell onto the floor.

Disclosed in U.S. Pat. No. 5,716,306 issued to Gallay is an apparatus that includes two vertical ropes, two rope clamps that each attach a barbell bar to one of the ropes, and a control bar that controls the rope clamps. While this apparatus addresses safety concerns in all three phases, it must be rigidly affixed to a barbell bar such that changing barbells is precluded, and hence, this apparatus is not suited for use with dumbbells.

SUMMARY

The present invention addresses such needs and deficiencies as are explained above by providing either one or a pair of exercise weight support devices that each include a retractable belt to enable suspension from a ceiling or other overhanging structural support, a retracting reel mechanism to selectively allow vertical movement of a supported weight, and a trigger handle operable in a manner akin to a dead man's switch to disallow lowering of the supported weight when the trigger handle is not continuously operated by a lifter. An upper end of the belt may be attached to the ceiling or other overhanging structural support by a carabiner or other hardware, and the retracting reel mechanism and the trigger handle may be co-located at the lower end of the retractable belt to enable the trigger handle to control operation of the retracting reel mechanism.

The retracting reel mechanism may incorporate a spring to tend to urge a spool to which the lower end of the belt is attached to wind up the belt to take slack out of the belt. The retracting reel mechanism may incorporate either a ratchet mechanism or a simpler brake mechanism to selectively stop at least the unwinding and paying out of the belt from the spool under the control of the trigger handle. The ability to selectively stop the paying out of the belt from the spool provides the ability to selectively stop the lowering of a supported barbell, dumbbell or other form of free weight used in weightlifting.

Each exercise weight support device may be used to reduce risk of injury and/or damage to property during a pre-lift phase by enabling a dumbbell, part of a barbell, or any of a variety of other types of weights used for weightlifting to be suspended from the ceiling or other overhanging support structure at a desired height that serves as a starting point for performing the reps of a lifting phase. Such suspension of weights enables the lifter to take whatever time is needed to position themselves and/or to make any other preparations for the lifting phase.

Each exercise weight support device may be used to reduce risk of injury and/or damage to property during a lifting phase and/or a post-lift phase by allowing a lifter to stop their performance of a rep mid stride if they should determine that they are unable to complete a rep. The lifter need only to let go of the trigger handle, thereby allowing the trigger handle to retract under the force exerted by one or more springs to an engaged position in which either the teeth of one or more ratchet gears are engaged or a simpler brake mechanism is engaged to stop at least the paying out of the belt from the retracting reel mechanism, thereby causing a weight that the lifter had ceased to lift to simply remain suspended at the height at which the lifter can let go of the trigger handle. Thus, if a lifter encounters difficulties in continuing to perform reps of a lifting exercise, the lifter does not need to allow the barbell, dumbbell or other weight they were lifting to fall.

It should be noted that although the discussion herein focuses on the use of embodiments with barbells and dumbbells, other embodiments are possible that may be used and/or may be configured for use with other types of free weights used in weightlifting.

BRIEF DESCRIPTION OF THE DRAWINGS

A fuller understanding of what is disclosed in the present application may be had by referring to the description and claims that follow, taken in conjunction with the accompanying drawings, wherein:

DETAILED DESCRIPTION

Figure 1:
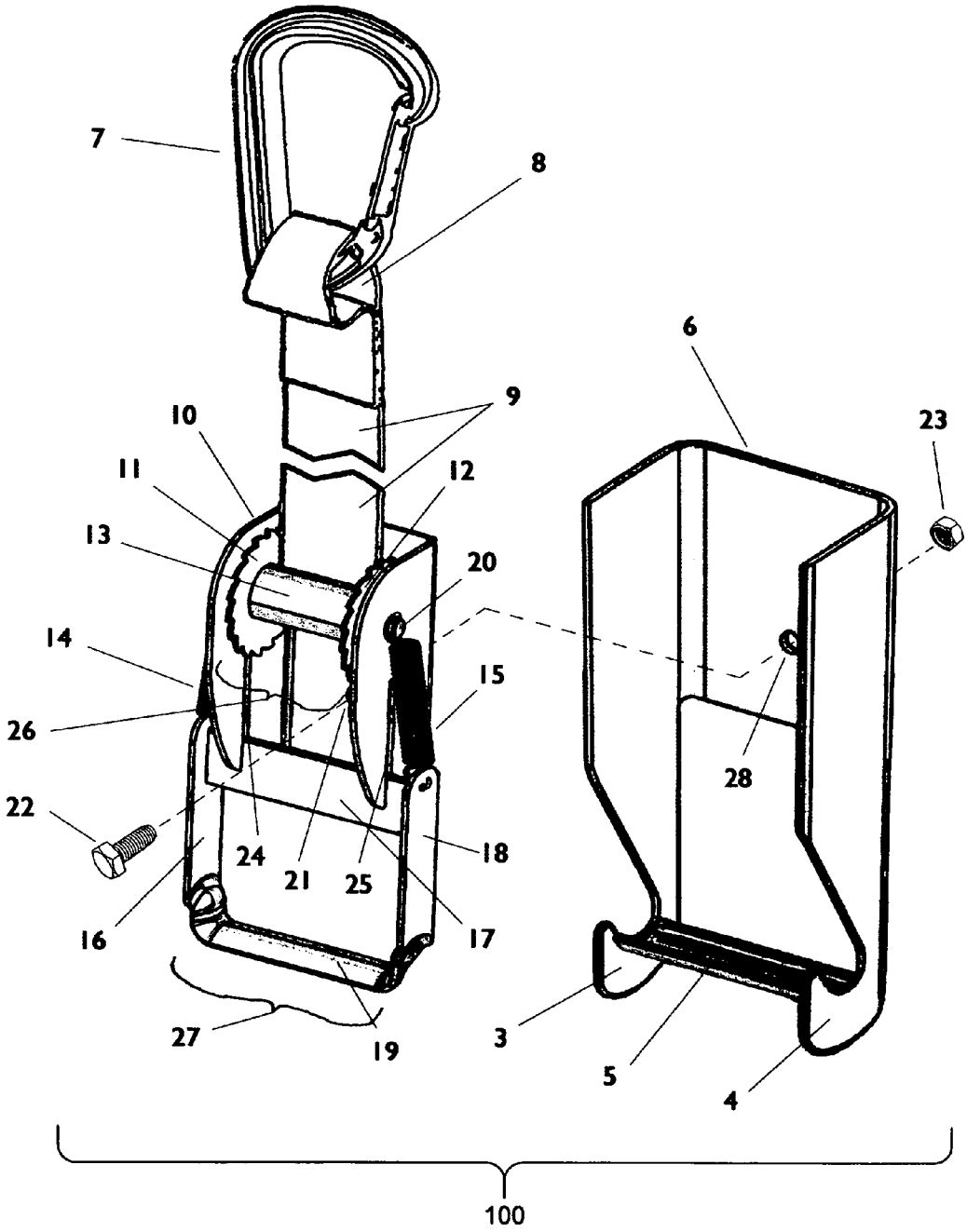
FIG. 1 is a partially exploded view of an embodiment of a single exercise weight support device, showing features of an outer frame and a retracting reel mechanism.

Referring to FIG. 1, an exercise weight support device for enhancing the safety of lifting exercises by selectively supporting a dumbbell or part of a barbell is indicated by the numeral 100. In some embodiments a single one of the exercise weight support devices 100 may be employed to selectively support a barbell prior to, during and following the performance of a lifting exercise. However, in other embodiments, a pair of the exercise weight support devices 100 may be employed to each selectively support a separate one of a pair of dumbbells or to each selectively support one of two spaced-apart portions of the bar of a barbell. More specifically, FIG. 1 shows a partially exploded view of an embodiment of a single exercise weight support device 100 incorporating a belt 9, a retracting reel mechanism 26 coupled to a lower end of the belt 9, a trigger handle 19 to operate the retracting reel mechanism 26, and an outer frame 6 coupled to the retracting reel mechanism 26 to support a bar of a dumbbell or part of a bar of a barbell.

The belt 9 may be formed from a length of relatively flat meshed webbing material similar to what may be employed in the making of seatbelts and/or tie-down straps for securing cargo, or any other suitable material for forming a belt with a tensile strength sufficient to support at least the weight of a dumbbell or part of the weight of a barbell. By way of example, at least a portion of the belt 9 may be made from one or more of woven polyester, nylon, polypropylene, Dyneema, Kevlar or other similar materials. The exercise weight support device 100 may be suspended by an upper end of the belt 9 from a ceiling or other overhead supporting structure, such as the metal framework of a cage or other structure of a piece of exercise equipment within a gym that is also capable of supporting the weight of a dumbbell or part of the weight of a barbell. An advantage of the use of the belt 9, with its relatively flat and wide cross-section, over a rope or cable of circular cross-section is the greater tendency for such a belt to resist twisting.

The upper end of the belt 9 may be formed into a loop 8 to wrap around a carabiner 7 and/or other hardware (e.g., a steel S-hook) that may be attached to the upper end of the belt 9 and used to engage a beam or other structure of a ceiling, or of some other overhead supporting structure. Alternatively, the upper end of the belt 9 may be formed into a loop 8 to directly wrap around such a beam or other overhead supporting structure. Such formation of the loop 8 may be through stitching of the upper end of the belt 9 onto a lower portion of itself near the upper end. As another alternative, the upper end of the belt 9 may not be formed into a loop at all, leaving the upper end of the belt 9 free to be wrapped around, clamped to and/or tied to a portion of ceiling structure or other overhead supporting structure. Still other approaches to enabling the upper end of the belt 9 to engage a portion of a ceiling or other overhead supporting structure will occur to those skilled in the art.

The lower end of the belt 9 may be wound around a spool 13 of the retracting reel mechanism 26 into which the belt 9 may be retracted and from which the belt 9 may be paid out to either shorten or lengthen, respectively, the portion of the belt 9 that extends upwards from the retracting reel mechanism 26 to a ceiling or other overhead supporting structure. The retracting mechanism 26 may include a torsion spring 20 housed within the core of the spool 13 and/or another component that tends to urge the spool 13 to rotate in a manner that retracts the belt 9 into the retracting reel mechanism 26, thereby tending to take up any slack in the belt 9 by tending to wrap more of the belt 9 around the spool 13. The amount of force applied by such a torsion spring or other component to take up slack in the belt 9 may be selected to balance out the weight of much of the exercise weight support device 100.

The outer frame 6 may be formed from rigid steel tubing cut to define a support plate to which the retracting reel mechanism 26 may be attached and to define a pair of spaced-apart and substantially identically configured hooks 3 and 4. More broadly, it may be deemed desirable to make many of the components of the exercise weight support device 100 from steel, or from a lighter weight rigid material such as carbon fiber. As depicted, one or more mounting holes 28 may be formed through the support plate to enable the retracting reel mechanism 26 to be attached thereto with one or more sets of bolts 22 and nuts 23 to enable the weight of a dumbbell or part of the weight of a barbell carried by the outer frame 6 to be supported by the retracting reel mechanism 26. Alternatively, any of a variety of other mounting formations, including and not limited to slots, tabs, hooks, standoffs, keyholes, etc. may be formed in and/or otherwise incorporated into the support plate of the outer frame 6 to enable the retracting reel mechanism 26 to be attached thereto.

The pair of hooks 3 and 4 may be spaced apart by a distance selected to be wide enough to allow a hand of a lifter to be inserted therebetween, but also narrow enough to allow the hooks 3 and 4 to fit between the weights of dumbbell as the bar of the dumbbell that extends between those weights is inserted into the interior spaces defined by each of the hooks 3 and 4. A cradle 5 may bridge between portions of the interior spaces defined by each of the hooks 3 and 4, and may form a curving trough within which such a bar of a dumbbell or a bar of a barbell may be seated upon being inserted into the interior areas defined by the hooks 3 and 4.

Thus, with a single one of the exercise weight support devices 100 suspended by the upper end of the belt 9 from a ceiling or other overhead supporting structure, a single dumbbell may be suspended and supported therefrom by inserting the bar thereof into the interior spaces defined by the hooks 3 and 4, and seating it within the trough defined by the cradle 5. Alternatively, with a spaced apart pair of the exercise weight support devices 100 suspended by the upper ends of the belts 9 of each from a ceiling or other overhead supporting structure, a barbell may be suspended and supported therefrom by supporting each of two spaced apart portions of the bar thereof within a separate one of the pair of exercise weight support devices 100 in a similar manner.

The trigger handle 19 may be movable between an engaged position in which the exercise weight support device 100 may be caused to support a dumbbell or part of a barbell, and a disengaged position in which exercise weight support device 100 may not provide such support. In the disengaged position, the trigger handle 19 is moved by a lifter into relatively close proximity to the bar of a dumbbell or a barbell that has been inserted into the interior areas defined by the hooks 3 and 4, and that has been seated within the trough defined by the cradle 5 (e.g., close enough to put the trigger handle 19 in contact with the bar or close enough that a finger tip cannot be inserted therebetween). In the engaged position, the trigger handle is allowed to be retracted from being in close proximity with the bar of such a dumbbell or barbell by one or more springs 14, 15 of the retracting reel mechanism 26 (e.g., retracted far enough away that a hand may be inserted between the trigger handle 19 and the bar).

With the trigger handle 19 allowed by a lifter to be retracted to the engaged position by the one or more springs 14, 15, the retracting reel mechanism 26 is caused to become engaged in a manner that prevents any more of the belt 9 from being unwound and paid out from the reel 13. As a result, with the exercise weight support device 100 suspended from overhead by the upper end of the belt 9, allowing the trigger handle 19 to be retracted to the engaged position triggers the retracting reel mechanism 26 to prevent the exercise weight support device 100 from being pulled further downward and away from the upper end of the belt 9 by either a lifter or the weight of either a dumbbell or at least part of a barbell. Thus, with the trigger handle 19 allowed by a lifter to retract to the engaged position, a dumbbell or at least part of a barbell supported within the cradle 5 and the hooks 3 and 4 is able to be suspended by the exercise weight support device 100 from a ceiling or other overhead support structure to which the upper end of the belt 9 is attached. In this way, one of the exercise weight support devices 100 may be caused to suspend a dumbbell or part of a barbell from a ceiling or other overhead supporting structure at a desired height, such as an upper position of a lifting exercise.

However, with the trigger handle 19 moved to the disengaged position against the force of the one or more springs 14, 15, the retracting reel mechanism 26 is caused to disengage to the extent of allowing the belt 9 to be both freely retracted to be wound about the spool 13 to take up slack in the belt 9 and freely unwound from the spool 13 and paid out. As a result, with the exercise weight support device 100 suspended from overhead by the upper end of the belt 9, moving the trigger handle 19 to the disengaged position triggers the retracting reel mechanism 26 to allow the exercise weight support device 100 to be either pulled further downward and away from the upper end of the belt 9, or to be lifted upward and toward the upper end of the belt 9 with the retracting reel mechanism 26 rewinding the belt 9 about the spool 13 to take up slack in the belt 9 as such upward lifting occurs. Thus, with the trigger handle 19 moved to the disengaged position, a dumbbell or at least part of a barbell supported within the cradle 5 and the hooks 3 and 4 is able to be freely raised or lowered by a lifter during the performance of a rep of a lifting exercise, with the belt 9 able to be freely retracted into or paid out from the retracting reel mechanism 26 as such raising and lowering for each rep occurs.

Thus, by allowing the trigger handle 19 to remain in the engaged position while the exercise weight support device 100 is suspended from overhead by the upper end of the belt 9, the exercise weight support device 100 can be caused to support a dumbbell or a portion of a barbell at a suspended vertical height selected by a lifter until the lifter is ready to perform reps of a lifting exercise. The lifter may then trigger the reel mechanism 26 to disengage to the extent of allowing those reps to be performed without interference by moving the trigger handle 19 to the disengaged position against the force of the one or more springs 14, 15 as the lifter performs those reps.

Upon completion of those reps or upon the lifter realizing that they are not able to continue performing those reps, the lifter need only let go of the trigger handle 19 to allow the trigger handle 19 to be retracted to the engaged position by the one or more springs 14, 15 to thereby cause the retracting reel mechanism 26 to once again become engaged to the extent of preventing the exercise weight support device 100 from being further pulled downward by the weight of the dumbbell or the weight of part of the barbell. In this way, both the lifting phase and the post-lift phase of a lifting exercise may be made considerably safer through the ability to cause the exercise weight support device 100 to selectively support the weight of a dumbbell or at least a portion of a barbell. There is no need for a lifter to drop dumbbells or a barbell in instances where the lifter realizes that they are not able to continue performing reps of a lifting exercise.

The exercise weight support device 100 may also be used to make the pre-lift phase of a lifting exercise safer by reducing the exertion required of the lifter to prepare for the lifting phase, and by eliminating the need to perform coordinated maneuvers involving multiple limbs to get dumbbells or a barbell into position to begin the lifting phase. With the trigger handle 19 moved to the disengaged position against the force of the one or more springs 14, 15, each of a pair of the exercise weight support devices 100 may first be moved vertically to whatever height is desired as the starting point for a lifting exercise. Once at the desired height, the trigger handle 19 of each of the exercise weight support devices 100 may be allowed to return to the engaged position to cause each of the exercise weight support devices 100 to remain at that desired height. Then, either the bar of each of a pair of dumbbells or spaced apart portions of the bar of a single barbell may be inserted into the cradle 5 and the hooks 3 and 4 of each of the pair of the exercise weight support devices 100. As long as the trigger handle 19 is allowed to remain in the engaged position, the pair of dumbbells or the barbell remains suspended at the desired height, thereby allowing the lifter as much time as needed to position themselves as desired in preparation to begin their lifting exercise.

Stated differently, as a result of the force exerted by the one or more springs 14, 15 to urge the trigger handle 19 towards the engaged position, the trigger handle 19 functions to some extent as a "dead man's switch" that serves to cause a cessation in at least a downward movement of a dumbbell or part of a barbell when the trigger handle 19 is not being continuously held in the disengaged position by a lifter. Thus, a lifter who comes to realize that they are unexpectedly unable to continue performing reps of a lifting exercise for whatever reason (e.g., a muscle spasm or over exertion, or a more serious event such as a heart attack) need only let go of the trigger handle 19 to allow it to move under the force of the one or more springs 14, 15 back to the engaged position. With the trigger handle 19 allowed to return to the engaged position, the retracting reel mechanism 26 is triggered to again engage to the extent of at least preventing a dumbbell or at least a portion of a barbell from falling either onto the floor or onto the lifter.

In some embodiments, the retracting reel mechanism 26 may be a self-contained retracting ratchet mechanism of the type often used with tie-down straps for securing cargo for vehicle transport. An example of such a retracting ratchet mechanism is disclosed in U.S. Pat. No. 7,503,736 issued to Chen, the disclosure of which is incorporated herein by reference in its entirety. As depicted in FIG. 1, such an implementation of the retracting reel mechanism 26 may include its own inner frame 10 that may be bolted to the outer frame 6 by one or more sets of the bolt 22 and the nut 23 extending through the one or more mounting holes 28 of the outer frame 6 and one or more mounting holes 21 (not visible) of the inner frame 10. In such an implementation of the retracting reel mechanism 26, the reel 13 may be coupled on each end to one of a pair of ratchet wheels 11 and 12 that are engaged by a ratchet pawl 17, which may be coupled to opposite ends of the trigger handle 19 by handle portions 16 and 18. Together, the ratchet pawl 17, the handle portions 16 and 18, and the trigger handle 19 form a handle assembly 27. The handle portions 16 and 18 may cooperate with corresponding ones of a pair of channels 24 and 25 formed in portions of the inner frame 10 to guide the ratchet pawl 17 in a sliding motion into and out of engagement with the ratchet teeth of the ratchet wheels 11 and 12. Such a sliding motion may be controlled by movement of the trigger handle 19 between the engaged position in which the ratchet pawl 17 is moved into engagement with the ratchet teeth of the ratchet wheels 11 and 12, and the disengaged position in which the ratchet pawl 17 is moved out of engagement with the ratchet teeth of the ratchet wheels 11 and 12.

In embodiments in which the retracting reel mechanism 26 is a retracting ratchet mechanism, the ratchet wheels 11 and 12 may be oriented to cause their ratchet teeth to interact with the ratchet pawl 17 in a manner that rotation of the spool 13 to unwind and pay out more of the belt 9 while the ratchet pawl 17 is moved into engagement with the ratchet teeth of the ratchet wheels 11 and 12 is prevented. However, movement of the spool 13 in the opposite direction to retract and wind more of the belt 9 onto the spool 13 while the ratchet pawl 17 is moved into engagement with the ratchet teeth of the ratchet wheels 11 and 12 may be permitted. Thus, the retracting reel mechanism 26 may allow the belt 9 to be retracted to take up slack in the belt as the exercise weight support device 100 is lifted with the trigger handle allowed to be retracted by the one or more springs 14, 15 into the engaged position.

In alternate embodiments, the retracting reel mechanism 26 may include a simpler brake mechanism in combination with the spool 13 urged into retracting the belt 9 by the torsion spring 20 in lieu of a retracting ratchet mechanism. In such embodiments, allowing the trigger handle 19 to be retracted by the one or more springs 14, 15 into the engaged position may trigger the engagement of the brake mechanism to prevent either retraction of the belt 9 into or paying out of the belt from the retracting reel mechanism 26.

Figure 2A:
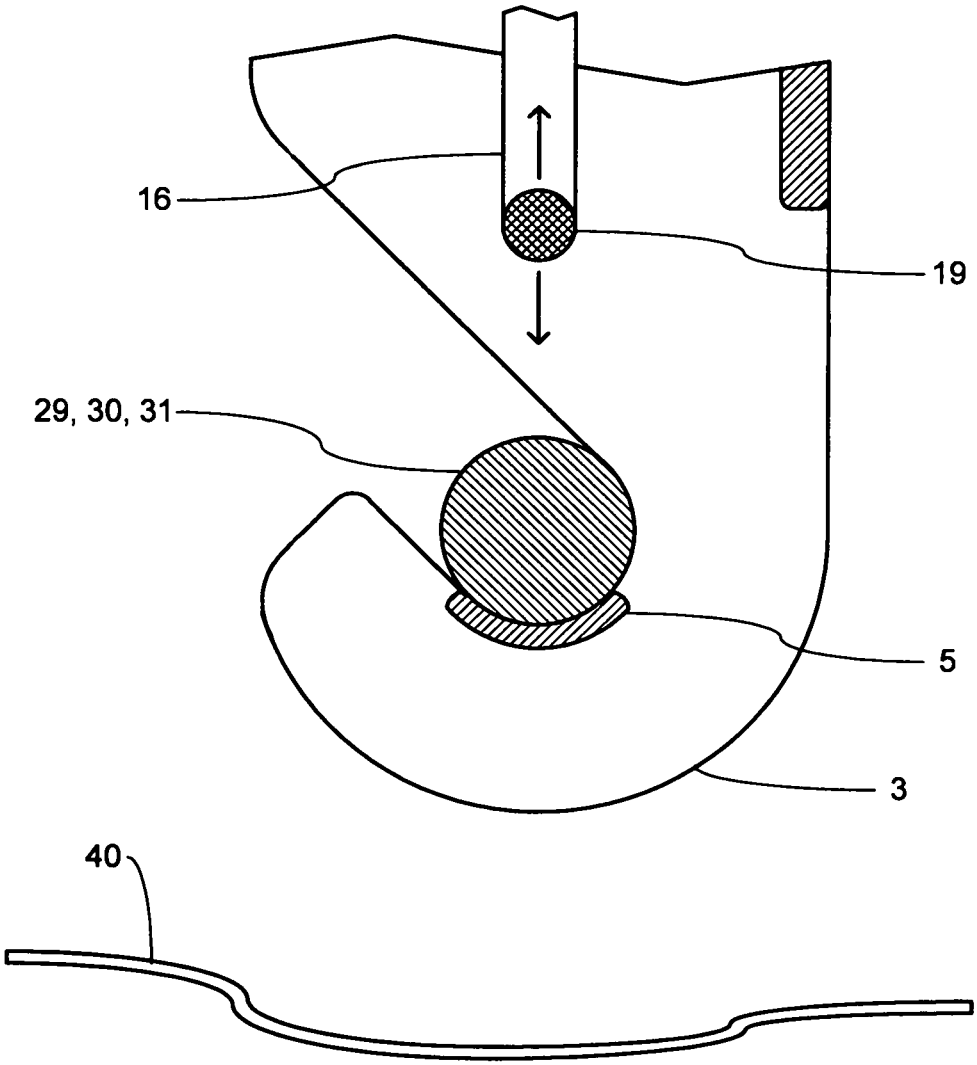
FIGS. 2A and 2B are each a cross-sectional view of a portion of an embodiment of a single exercise weight support device, showing aspects of a sliding motion of a trigger handle between engaged and disengaged positions, and showing differing cross-sections of the trigger handle.
Figure 2B:
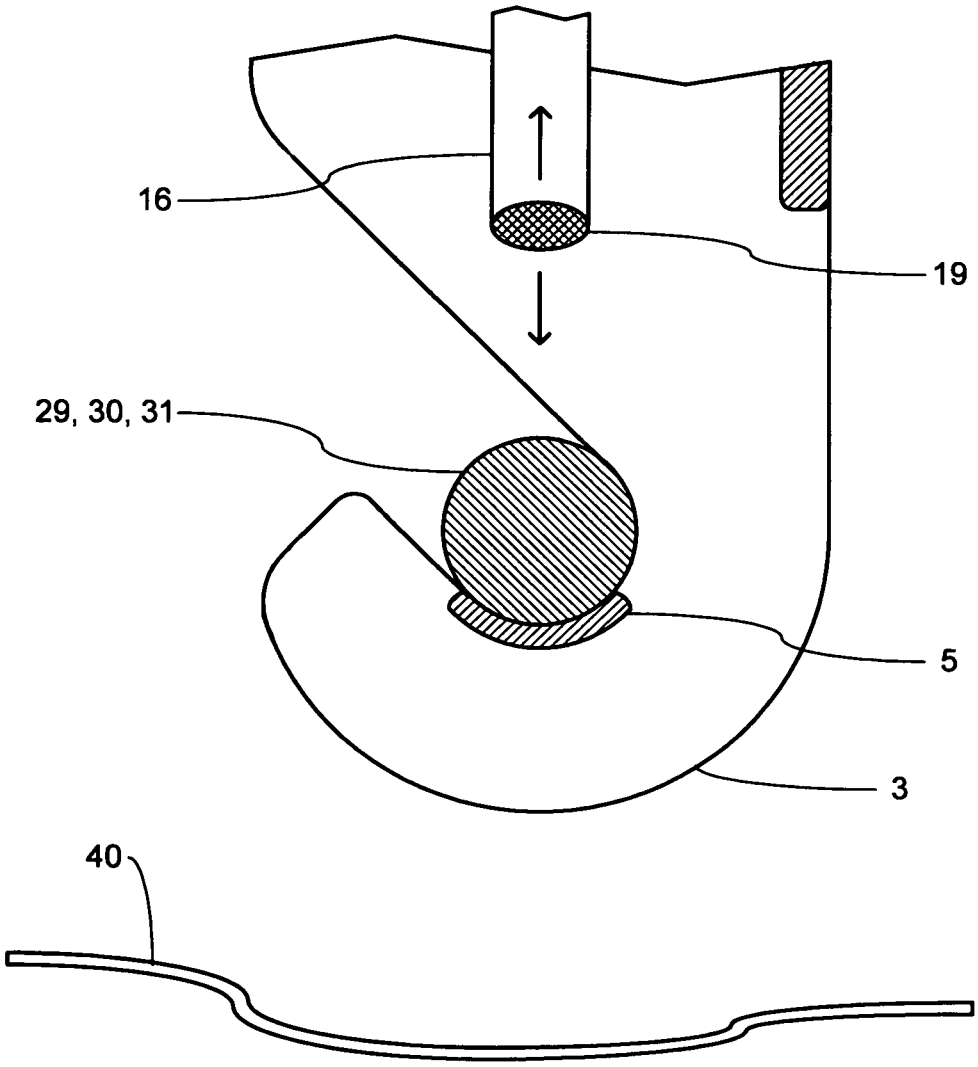

As has been described, the trigger handle 19 may be moved in a sliding motion between the engaged position in which the trigger handle is allowed to be retracted by the one or more springs 14, 15 away from the bar of a dumbbell or part of the bar of a barbell, and the disengaged position in which the trigger handle is pulled against the one or more springs 14, 15 into relatively close proximity to such a bar. FIGS. 2A and 2B are each a cross-sectional view of a portion of the exercise weight support device 100 taken through a portion of each of the cradle 5, the support plate of the outer frame 6, the trigger handle 19, and either a bar of a barbell 31 or a bar of a dumbbell 29 or 30. From the perspective provided by both FIGS. 2A and 2B, an elevational view of the hook 3 of the outer frame 6 and of the handle portion 16 of the handle assembly 27 can be clearly seen, as well as an example of one possible pathway of sliding motion for the trigger handle 19 to follow between engaged and disengaged positions, as indicated with arrows.

Also, as can be appreciated from a comparison between FIGS. 2A and 2B, the cross-section of the trigger handle 19 may differ in different embodiments. It may be that one or the other of these depicted cross-sections for the trigger handle 19, or one or more other cross-sections not depicted for the trigger handle 19, may be selected based on such factors as the diameter or cross-section of the bar of the barbell 31 or of the dumbbell 29 or 30. Also, regardless of what cross-section may be selected for the trigger handle 19, it may be deemed desirable for the selected cross-section to incorporate rounded edges to avoid instances of pinching portions of the skin of a hand therebetween.

Further, as can be appreciated from the perspective of both FIGS. 2A and 2B, the cradle 5 and the trigger handle 19 may be sized and shaped to enable the inner surfaces of the palm and fingers of a hand to wrap around all three of the cradle 5, the trigger handle 19, and the bar of either a barbell 31 or of a dumbbell 29 or 30. As can also be seen from this perspective, the cradle 5 may be given a cross-section that defines a concave surface that faces and closely follows part of the circular cross-section of the bar, and defines a corresponding convex surface that substantially mimics the that same part of the circular cross-section of that bar. As a result, an exertion of upward force against at least the combination of the cradle 5 and the bar of either a barbell 31 or of a dumbbell 29 or 30 is likely to be directed against the convex surface defined by the depicted cross-section of the cradle 5. The fact that the convex surface of the cradle 5 does substantially mimic part of the circular cross-section of the bar, may desirably result in the use of the combination of the exercise weight support device 100 and either the barbell 31 or the dumbbell 29 or 30 feeling little different to a lifter than lifting only the barbell 31 or the dumbbell 29 or 30.

With a palm and fingers of a hand of a lifter wrapped around at least the combination of the cradle 5 and the bar of a barbell 31 or of a dumbbell 29 or 30, a combination of gravity and the grip of the lifter's own hand may cooperate to maintain the bar within the interior areas defined by the hooks 3 and 4, and as seated within the trough defined by the cradle 5. Also, where the trigger handle 19 is moved into contact with the bar, the bar may be sandwiched between the trigger handle 19 and the cradle 5, thereby aiding in maintaining the bar within the interior areas defined by the hooks 3 and 4, and as seated within the trough defined by the cradle 5.

However, FIGS. 2A and 2B also depict an edge-on view of a sheet 40 of hook-and-loop fastening material with hooks on one side and loops on the other such that hooks one side of the sheet 40 of hook-and-loop fastening material are able to engage and maintain a hold on the loops on the other side. The sheet 40 may be sized to be wide enough to cover the full length of the cradle 5, and also to be long enough to wrap around the combination of the cradle 5 and the bar of a barbell 31 or of a dumbbell 29 or 30. Thus, after the bar has been inserted into the interior areas defined by the hooks 3 and 4, and after the bar has been seated within the trough defined by the cradle 5, the sheet 40 of hook-and-loop fasteners may be wrapped around the combination of the bar and the cradle 5 to assist in keep the bar seated within the cradle 5.

Figure 3:
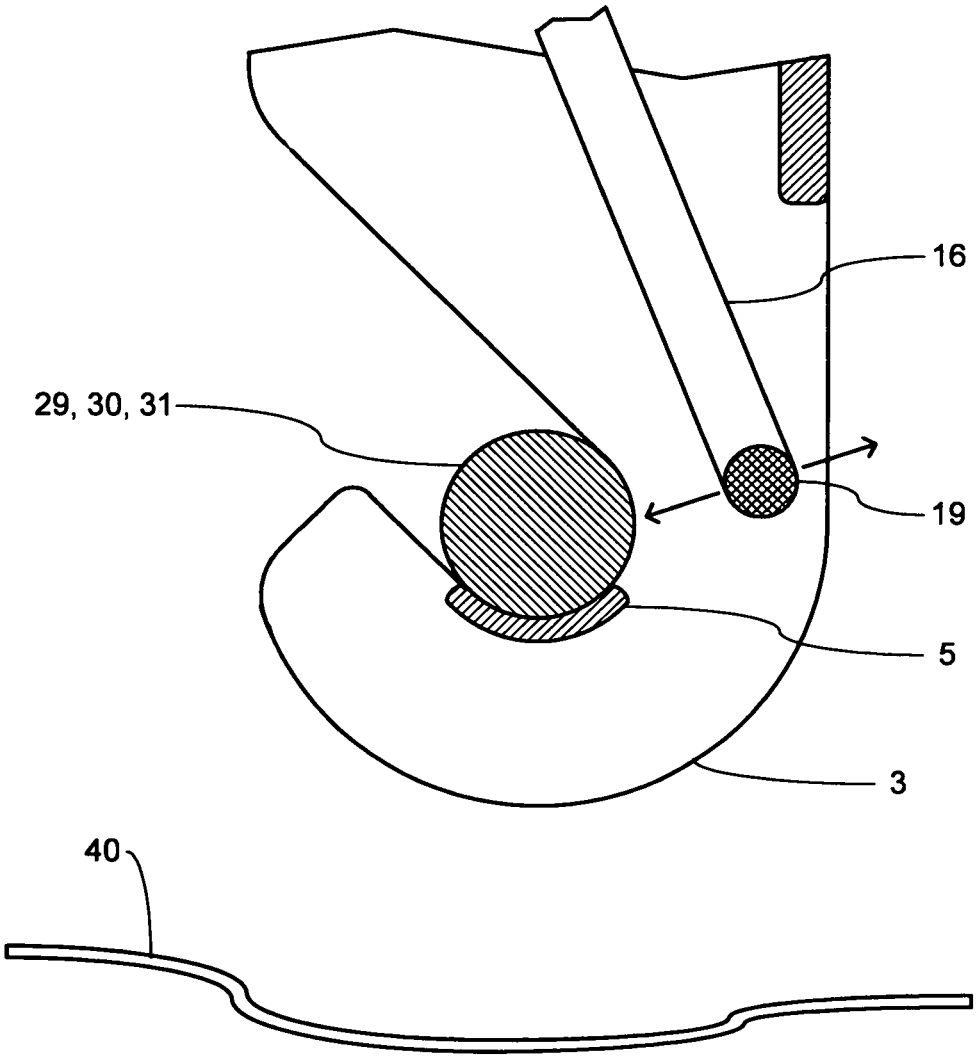
FIG. 3 is a cross-sectional view of the same portion of an embodiment of a single exercise weight support device as depicted in FIGS. 2A and 2B, showing aspects of a swinging motion of a trigger handle between engaged and disengaged positions.

FIG. 3 depicts a cross-section of a portion of the exercise weight support device 100 from the same perspective as FIGS. 2A and 2B. As an alternative to the earlier discussed sliding motion of the trigger handle 19 depicted in FIGS. 2A and 2B, FIG. 3 depicts an alternate swinging movement of the trigger handle 19 between engaged and disengaged positions. In the disengaged position, the trigger handle 19 is swung by a lifter into relatively close proximity to the bar of a barbell 31 or of a dumbbell 29 or 30 that has been inserted into the interior areas defined by the hooks 3 and 4, and that has been seated within the trough defined by the cradle 5 (e.g., close enough to put the trigger handle 19 in contact with the bar or close enough that a finger tip cannot be inserted therebetween). In the engaged position, the trigger handle is allowed to be retracted in a swinging action away from being in close proximity with the bar of such a dumbbell or barbell by one or more springs (not shown) of the retracting reel mechanism 26 (e.g., retracted far enough away that a hand may be inserted between the trigger handle 19 and the bar).

Figure 4:
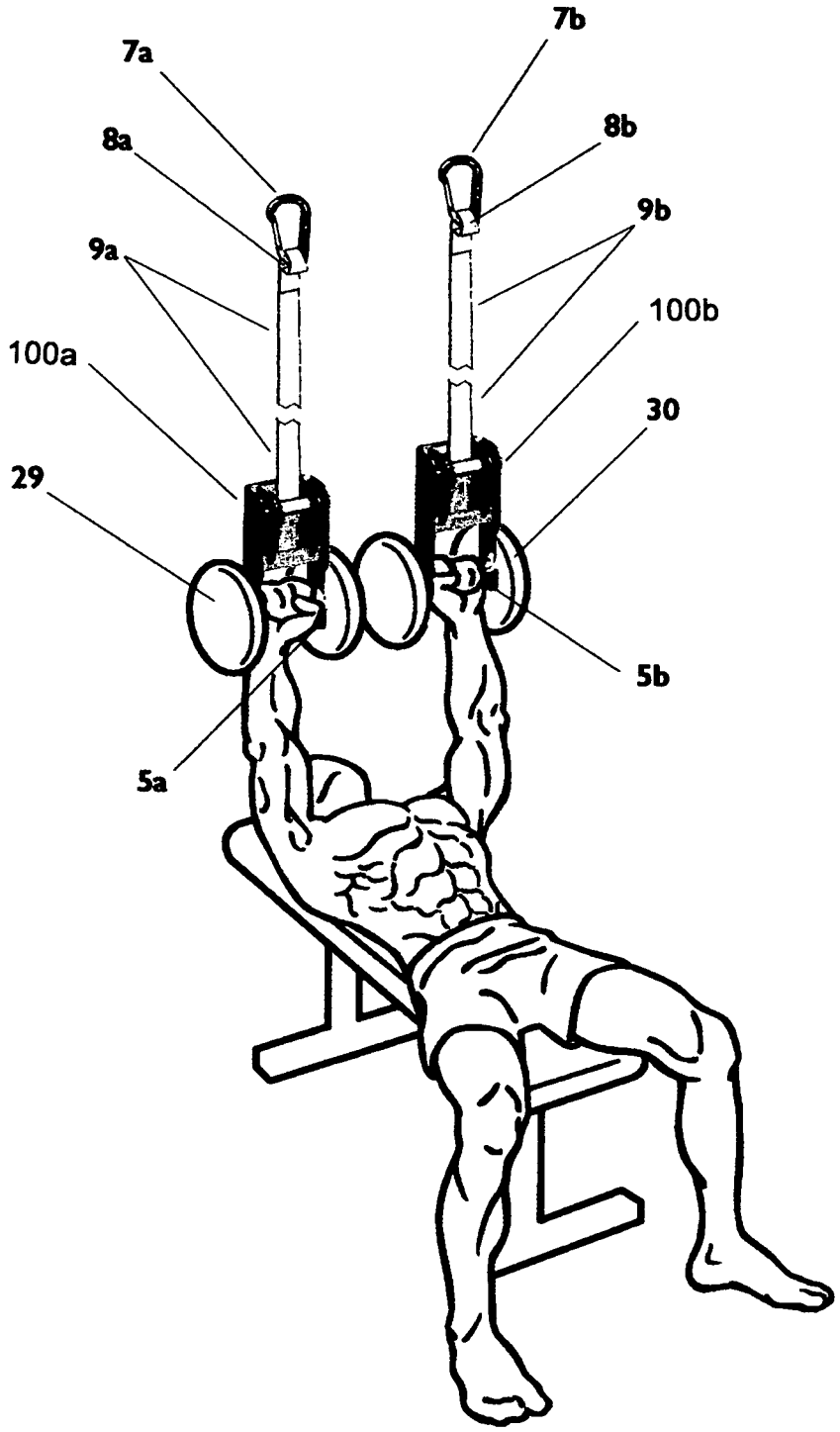
FIG. 4 is a perspective view of an example use of two of an example embodiment of an exercise weight support device in a performance of a flat bench dumbbell press exercise.

FIG. 4 depicts an example performance of a flat bench dumbbell press exercise that employs a pair of the exercise weight support devices 100, labeled as exercise weight support devices 100*a* and 100*b* to distinguish between them. As depicted, the exercise weight support device 100*a*, which incorporates one or more of carabiner 7*a*, attached to belt 9*a* via a loop 8*a*, and a cradle 5*a*, is employed to selectively support dumbbell 29. Correspondingly, the exercise weight support device 100*b*, which incorporates one or more of carabiner 7*b*, attached to belt 9*b* via a loop 8*b*, and a cradle 5*b*, is employed to selectively support dumbbell 30. The exercise weight support devices 100*a* and 100*b* may be of identical design such that they may be interchanged with each other, the dumbbells 29 and 30 may be swapped between them, and the components of each may be interchanged.

Figure 5:
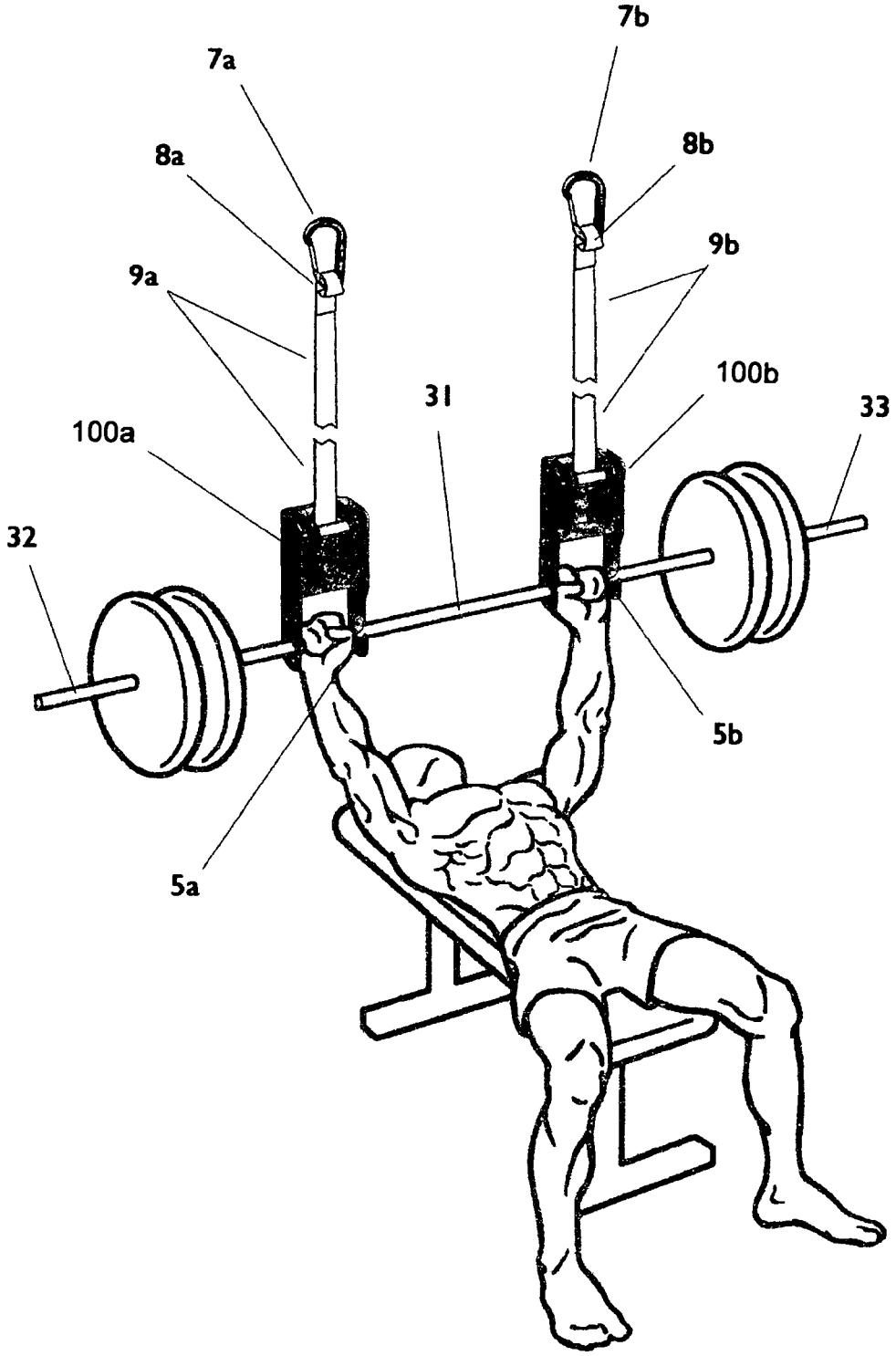
FIG. 5 is a perspective view of an example use of two of an example embodiment of an exercise weight support device in a performance of a flat bench barbell press exercise.

FIG. 5 depicts an example performance of a flat bench barbell press exercise (also commonly referred to as a bench press) that also employs a pair of the exercise weight support devices 100, that again may be of identical design, and are again labeled as exercise weight support devices 100*a* and 100*b* to distinguish between them. As depicted, the exercise weight support device 100*a*, which incorporates one or more of carabiner 7*a*, attached to belt 9*a* via a loop 8*a*, and a cradle 5*a*, is employed to selectively support a left end 32 of barbell 31. Correspondingly, the exercise weight support device 100*b*, which incorporates one or more of carabiner 7*b*, attached to belt 9*b* via a loop 8*b*, and a cradle 5*b*, is employed to selectively support a right end 33 of the barbell 31.

Figure 6A:
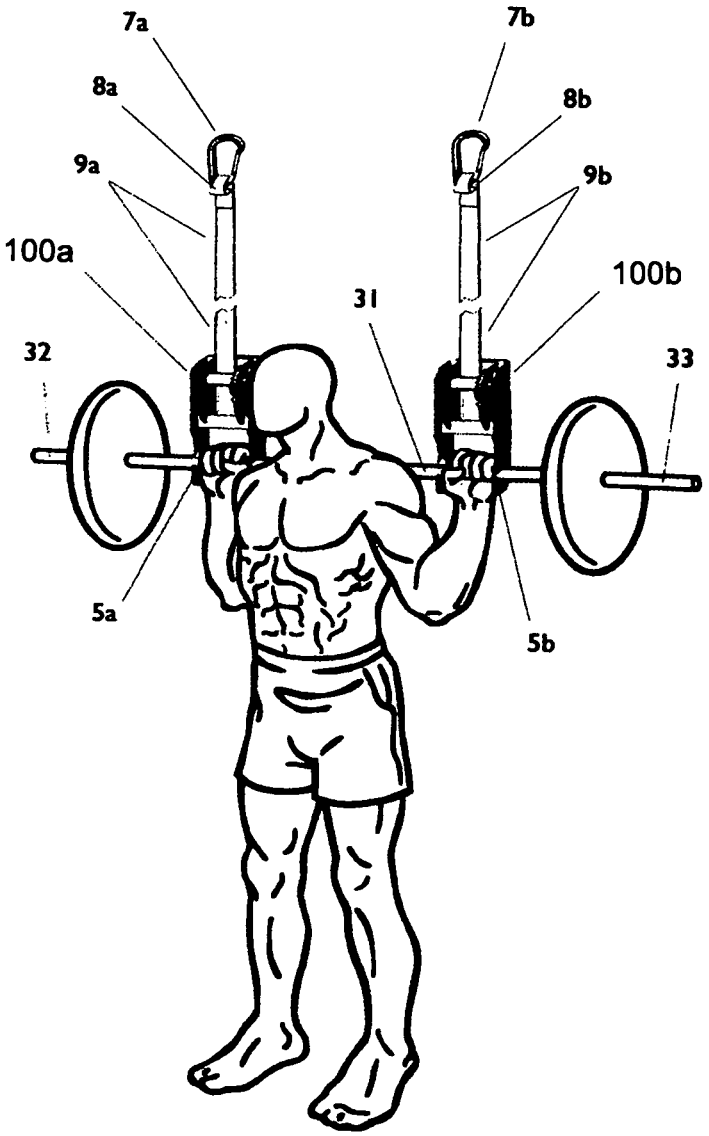
FIGS. 6A and 6B are each a perspective view of a different part of an example use of two of an example embodiment of an exercise weight support device in a performance of a standard squat exercise.
Figure 6B:
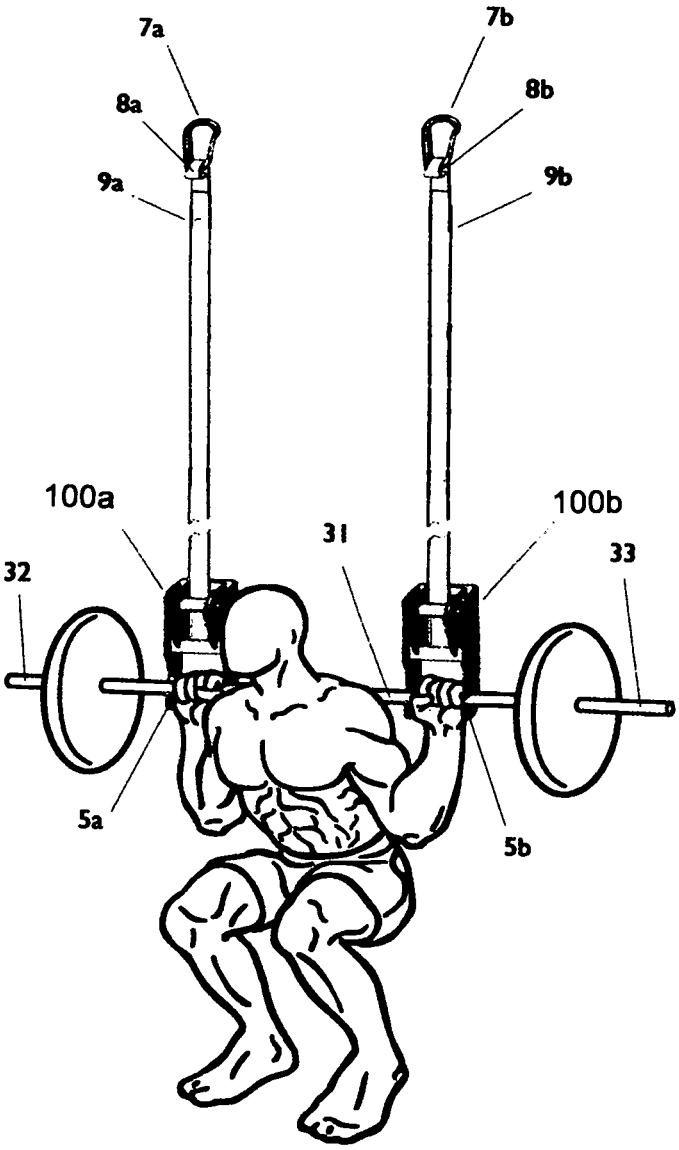

FIGS. 6A and 6B, together, depict two different parts of a rep of an example performance of a standard squat exercise (also commonly referred to as a squat) that again employs a pair of the exercise weight support devices 100 of identical design, and are again labeled as exercise weight support devices 100*a* and 100*b* to distinguish between them. As depicted, the exercise weight support devices 100*a* and 100*b* are again employed to selectively support the left end 32 and right end 33, respectively, of barbell 31. FIG. 6A depicts a part of the standard squat in which the barbell 31 lifted to an upper position, and FIG. 6B depicts a part of the standard squat in which the barbell 31 is lowered to a lower position.

Figure 7:
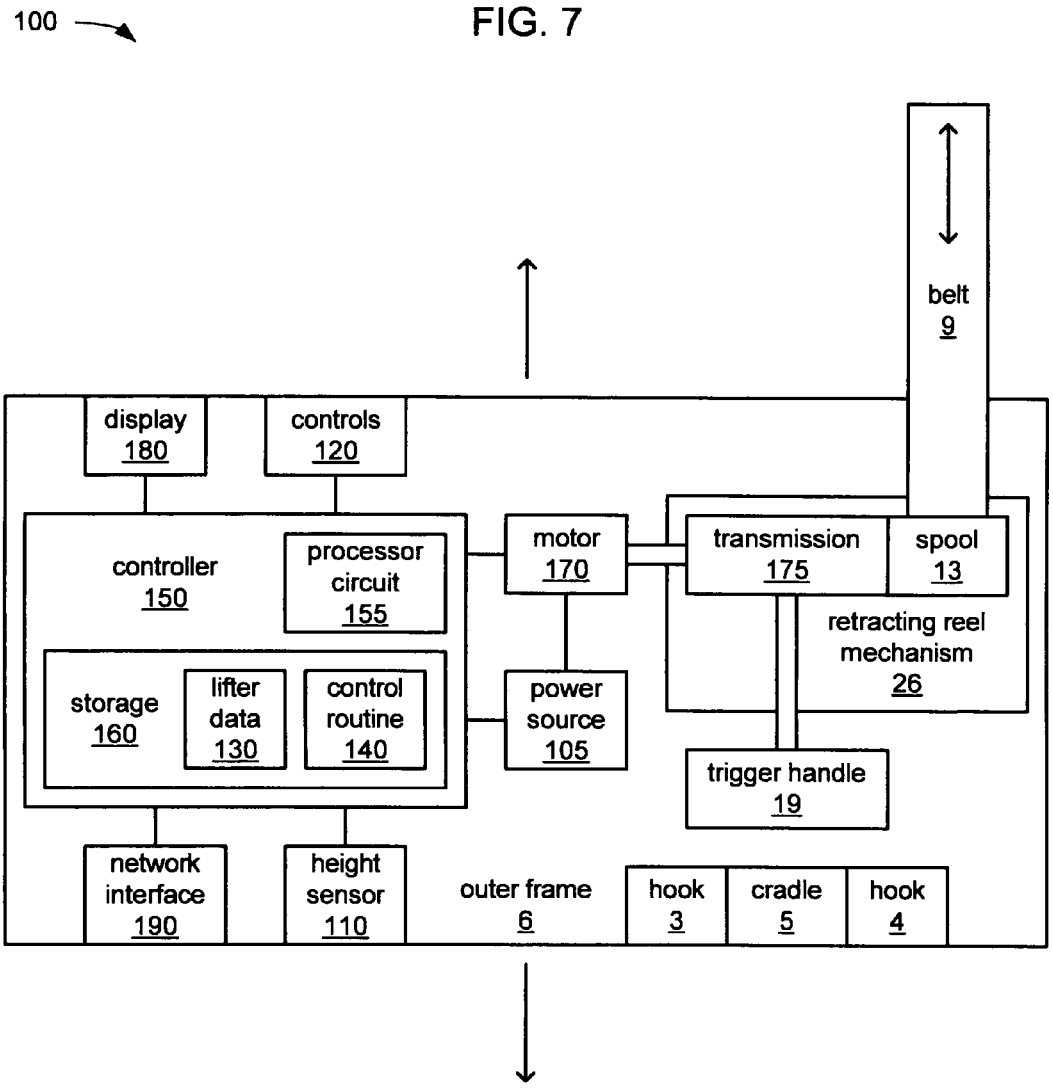
FIG. 7 is a block diagram of another embodiment of a single exercise weight support device, showing processor-based automated features thereof.

FIG. 7 depicts a block diagram of an embodiment of the exercise weight support device 100 that incorporates some degree of automation to increase convenience and/or ease of use. As depicted, such additional components may be in addition to at least a subset of the various components of the exercise weight support device 100 that have already been discussed above, including and not limited to, the frame 6, the hooks 3 and 4, the cradle 5, retracting reel mechanism 26, the spool 13, the belt 9 and the trigger handle 19. Additional components beyond what has been discussed above may be mounted to, carried by and/or otherwise incorporated into the frame 6, including and not limited to, one or more of a controller 150, a power source 105, a height sensor 110, manually-operable controls 120, a motor 170, a display 180, and a network interface 190. The controller 150 may incorporate a processor circuit 155, and a storage 160 storing one or both of a control routine 140 and lifter data 130. Also, the retracting reel mechanism 26 may additionally incorporate a transmission 175 to enable the spool 13 to be controlled by operation of the trigger handle 19, as has been described earlier, by operation of the motor 170, or by both.

The control routine 140 may include a sequence of instructions to implement logic to perform one or more functions. The processor circuit 155 is coupled to the storage 160 and may access the control routine 140 within the storage 160 to execute the control routine 140, thereby causing the processor circuit 155 to perform one or more of those various functions. The processor circuit 155 may be any of a variety of commercially available processors, employing any of a variety of processing technologies and implemented with one or more cores physically and electrically combined in any of a number of ways. The storage 160 may be made up of one or more distinct storage devices that each may be based on any of a wide variety of storage technologies of volatile and/or non-volatile nature.

More specifically, in executing the control routine 140, the processor circuit 155 may be caused to operate the controls 120 and/or the display 180 (if either or both are present) to provide a user interface to a lifter engaged in weightlifting. The controls 120 may be made up of any of a variety of switches, buttons, keypads, touch-sensitive surfaces and/or other components that enable the lifter to provide input. The display 180 may made up of one or more distinct components that are able to visually present information, ranging from one or more light-emitting diodes (LEDs) to a dot-matrix liquid-crystal display (LCD). Alternatively or additionally, in executing the control routine 140, the processor circuit 155 may be caused to operate the network interface 190 to interact with a smartphone, tablet computer or other device that may be operated by the lifter as an alternate approach to providing the lifter a user interface.

Among the purposes for which such a user interface may be provided, either directly through the controls 120 and/or the display 180, or indirectly through the network interface 190 interacting with another device, may be to allow the lifter to turn the controller 150 on or off, or to provide the controller 150 with any of a variety of commands or other information pertinent to performing those commands. By way of example, as part of preparing to perform a lifting exercise, the lifter may desire to have the exercise weight support device 100 either retract or pay out some of the belt 9 to adjust the height of the at which the exercise weight support device 100 may currently be supporting a barbell, a dumbbell or another form of free weight. It may be that the lifter operates the controls 120 to command the processor circuit 155 to operate the motor 170 to drive the spool 13 through the transmission 175 to retract or pay out the belt 9 to thereby raise or lower the exercise weight support device 100. In some embodiments, the command may be a simple raise or lower command that the lifter may operate the controls 120 to continue to provide until the desired height is achieved. In some embodiments, the command may specify a particular measured height from a floor. In some embodiments, the command may include the identity of the lifter and an indication of the particular lifting exercise that is about to be performed.

Where the command specifies a particular height from the floor, the processor circuit 155 may operate the height sensor 140 to determine the current height of the exercise weight support device 100 from the floor, and may then operate the motor 170 to cause retraction or paying out of the belt 9 to change the height of the exercise weight support device 100 until the specified height is reached. The height sensor 140 may be based on any of a variety of technologies for measuring the distance to a floor, including and not limited to emitting ultrasound pulses and determining how long an reflection of those pulses take to return, etc. Where the command specifies the identity of the lifter and includes an indication of the lifting exercise to be performed, the processor circuit 155 may access indications of the preferred starting heights of the lifter for various exercises to retrieve an indication of what height to either raise or lower the exercise weight support device 100 to by use of the motor 170.

Given the possibility of data errors, processing errors, loss of power from the power source 105 and/or other forms of malfunction that may befall automated systems such as the controller 150, the transmission 175 may be configured to ensure that operation of the trigger handle 19, as has been described above, is never compromised by an action taken by the processor circuit 155, and/or is always able to override an action taken by the processor circuit 155. Correspondingly, the transmission 175 may also be configured to ensure that the operation of the trigger handle 19, as has been described above, is never dependent upon the power source 105 being able to provide electric power to the controller or upon the controller 150 functioning correctly. Indeed, it may be deemed desirable for the embodiment of the exercise weight support device 100 depicted in FIG. 7 to be operable entirely by the trigger handle 19, as has been described above, as if the controller 150 and the motor 170 were not present. Thus, the transmission 175 may incorporate either components of a ratchet mechanism (e.g., a ratchet wheel) or components of a brake mechanism that may be operable solely through movement of the trigger handle 19 between the engaged and disengaged positions.

Although the invention has been described in a preferred form with a certain degree of particularity, it is understood that the present disclosure of the preferred form has been made only by way of example, and that numerous changes in the details of construction and the manner of manufacture may be resorted to without departing from the spirit and scope of the invention. It is intended to protect whatever features of patentable novelty exist in the invention disclosed.

The invention claimed is:

1. An exercise weight support device comprising:

a frame;

a spool of a retracting reel mechanism carried by the frame, the spool attached to a lower end region of a belt, with the retracting reel mechanism being operable to retract and wind the belt around the spool to take up slack in the belt;

a cradle carried by the frame to support a bar of a free weight seated within a trough defined by the cradle when an upper end region of the belt is suspended from an overhanging support structure, the cradle comprising an elongate member extending between the pair of hooks, and having a curved cross-section that defines a concave surface that defines the trough and a convex surface that mimics a portion of a curved surface of the bar of the free weight to enable a palm and inner surfaces of fingers of the hand to wrap around the combination of the cradle and the bar of the free weight, and to enable a lifter to lift the free weight by pressing upwardly against the convex surface of the cradle;

a trigger handle connected to the retracting reel mechanism and movable between engaged and disengaged positions, wherein movement of the trigger handle to the engaged position triggers the retracting reel mechanism to prevent rotation of the spool to pay out the belt to prevent lowering of the free weight, and wherein movement of the trigger handle to the disengaged position causes the retracting reel mechanism to allow the spool to rotate to either retract or pay out the belt to allow the free weight to be raised or lowered;

a spring biasing the trigger handle toward the engaged position when the trigger handle is not moved toward the disengaged position, with the disengaged position being closer in proximity to the bar of the free weight than the engaged position; and a pair of identically configured hooks defined by the frame to cooperate with the trough to support the bar of the free weight when the frame is suspended from the overhanging support structure.

2. The exercise weight support device of claim 1, wherein the belt has a relatively flat and wide cross-section that minimizes twisting of the belt while suspending the frame from the overhanging support structure.

3. The exercise weight support device of claim 1, further comprising a torsion spring disposed within a core of the spool to urge the spool to retract and to wind the belt around the spool.

4. The exercise weight support device of claim 1, wherein the pair of identically configured hooks are spaced apart by a distance that enables a hand of a lifter to fit therebetween while wrapping around a combination of the cradle and the bar of the free weight.

5. The exercise weight support device of claim 4, wherein the free weight is a dumbbell, and the distance by which the identically configured hooks are spaced apart enables the pair of hooks and the cradle to fit between enlarged portions of the dumbbell to enable the bar of the dumbbell to seat within the trough defined by the cradle.

6. An exercise weight support device comprising:

a frame;

a spool of a retracting reel mechanism carried by the frame, the spool attached to a lower end region of a belt, with the retracting reel mechanism being operable to retract and wind the belt around the spool to take up slack in the belt;

a cradle carried by the frame to support a bar of a free weight seated within a trough defined by the cradle when an upper end region of the belt is suspended from an overhanging support structure;

a trigger handle connected to the retracting reel mechanism and movable between engaged and disengaged positions, wherein movement of the trigger handle to the engaged position triggers the retracting reel mechanism to prevent rotation of the spool to pay out the belt to prevent lowering of the free weight, and wherein movement of the trigger handle to the disengaged position causes the retracting reel mechanism to allow the spool to rotate to either retract or pay out the belt to allow the free weight to be raised or lowered; and a spring biasing the trigger handle toward the engaged position when the trigger handle is not moved toward the disengaged position, with the disengaged position being closer in proximity to the bar of the free weight than the engaged position, wherein:

the trigger handle is slidable between the engaged and disengaged positions;

the spring biases the trigger handle toward the engaged position and away from the cradle when the trigger handle is not moved toward the disengaged position;

movement of the trigger handle from the engaged position to the disengaged position requires pulling of the trigger handle against the biasing action of the spring towards the cradle, and towards the bar of the free weight when the bar of the free weight is seated within the trough defined by the cradle;

the cradle engages the bar of the free weight from beneath the bar, and the trigger handle is positioned above the bar when the frame is suspended from the overhanging support structure by the belt and the bar is seated within the trough defined by the cradle;

movement of the trigger handle from the engaged position to the disengaged position includes pulling the trigger handle in a downward sliding motion into contact with the bar of the free weight such that the bar of the free weight becomes sandwiched between the cradle and the trigger handle when the frame is suspended from the overhanging support structure by the belt, and when the bar of the free weight is seated in the trough; and the trigger handle has a cross-section that enables a palm and inner surfaces of fingers of a hand of a lifter to wrap around a combination of the trigger handle, the cradle and the bar of the free weight.

7. The exercise weight support device of claim 6, wherein the belt has a relatively flat and wide cross-section that minimizes twisting of the belt while suspending the frame from the overhanging support structure.

8. The exercise weight support device of claim 6, further comprising a torsion spring disposed within a core of the spool to urge the spool to retract and to wind the belt around the spool.

9. An exercise weight support device comprising:

a frame;

a spool of a retracting reel mechanism carried by the frame, the spool attached to a lower end region of a belt, with the retracting reel mechanism being operable to retract and wind the belt around the spool to take up slack in the belt;

a cradle carried by the frame to support a bar of a free weight seated within a trough defined by the cradle when an upper end region of the belt is suspended from an overhanging support structure;

a trigger handle connected to the retracting reel mechanism and movable between engaged and disengaged positions, wherein movement of the trigger handle to the engaged position triggers the retracting reel mechanism to prevent rotation of the spool to pay out the belt to prevent lowering of the free weight, and wherein movement of the trigger handle to the disengaged position causes the retracting reel mechanism to allow the spool to rotate to either retract or pay out the belt to allow the free weight to be raised or lowered; and a spring biasing the trigger handle toward the engaged position when the trigger handle is not moved toward the disengaged position, with the disengaged position being closer in proximity to the bar of the free weight than the engaged position, wherein:

the trigger handle moves in a swinging motion between the engaged and disengaged positions;

the spring biases the trigger handle towards the engaged position and away from the cradle when the trigger handle is not moved toward the disengaged position; and movement of the trigger handle from the engaged position to the disengaged position requires pulling of the trigger handle against the biasing action of the spring towards the cradle, and towards the bar of the free weight when the bar of the free weight is seated within the trough defined by the cradle.

10. The exercise weight support device of claim 9, wherein:

the retracting reel mechanism comprises a brake connected to the trigger handle;

movement of the trigger handle to the engaged position triggers the brake to engage to prevent rotation of the spool to either retract or pay out the belt to prevent raising or lowering of the free weight when the frame is suspended from the overhanging support structure by the belt; and movement of the trigger handle to the disengaged position triggers the brake to disengage to allow the spool to rotate to either retract or pay out the belt to allow the free weight to be raised or lowered when the frame is suspended from the overhanging support structure by the belt.

11. The exercise weight support device of claim 9, wherein the belt has a relatively flat and wide cross-section that minimizes twisting of the belt while suspending the frame from the overhanging support structure.

12. The exercise weight support device of claim 9, further comprising a torsion spring disposed within a core of the spool to urge the spool to retract and to wind the belt around the spool.

13. An exercise weight support device comprising:

a frame;

a spool of a retracting reel mechanism carried by the frame, the spool attached to a lower end region of a belt, with the retracting reel mechanism being operable to retract and wind the belt around the spool to take up slack in the belt;

a cradle carried by the frame to support a bar of a free weight seated within a trough defined by the cradle when an upper end region of the belt is suspended from an overhanging support structure;

a trigger handle connected to the retracting reel mechanism and movable between engaged and disengaged positions, wherein movement of the trigger handle to the engaged position triggers the retracting reel mechanism to prevent rotation of the spool to pay out the belt to prevent lowering of the free weight, and wherein movement of the trigger handle to the disengaged position causes the retracting reel mechanism to allow the spool to rotate to either retract or pay out the belt to allow the free weight to be raised or lowered; and a spring biasing the trigger handle toward the engaged position when the trigger handle is not moved toward the disengaged position, with the disengaged position being closer in proximity to the bar of the free weight than the engaged position, wherein:

the retracting reel mechanism comprises a retracting ratchet mechanism that comprises a ratchet wheel drivingly connected to the spool;

the trigger handle is connected to a pawl that is movable with the handle between the engaged and disengaged positions;

movement of the trigger handle to the engaged position moves the pawl into engagement with teeth of the ratchet wheel to prevent rotation of the spool to pay out the belt to prevent lowering of the free weight when the frame is suspended from the overhanging support structure by the belt; and movement of the trigger handle to the disengaged position moves the pawl away from the ratchet wheel to allow the spool to rotate to either retract or pay out the belt to allow the free weight to be raised or lowered when the frame is suspended from the overhanging support structure by the belt.

14. The exercise weight support device of claim 13, wherein the engagement of the pawl with the teeth of the ratchet wheel while the trigger handle is moved to the engaged position enables the spool to rotate to retract the belt to take up slack in the belt if the free weight is raised when the frame is suspended from the overhanging support structure by the belt.

15. An exercise weight support device comprising:

a frame;

a spool of a retracting reel mechanism carried by the frame, the spool attached to a lower end region of a belt, with the retracting reel mechanism being operable to retract and wind the belt around the spool to take up slack in the belt;

a cradle carried by the frame to support a bar of a free weight seated within a trough defined by the cradle when an upper end region of the belt is suspended from an overhanging support structure;

a trigger handle connected to the retracting reel mechanism and movable between engaged and disengaged positions, wherein movement of the trigger handle to the engaged position triggers the retracting reel mechanism to prevent rotation of the spool to pay out the belt to prevent lowering of the free weight, and wherein movement of the trigger handle to the disengaged position causes the retracting reel mechanism to allow the spool to rotate to either retract or pay out the belt to allow the free weight to be raised or lowered;

a spring biasing the trigger handle toward the engaged position when the trigger handle is not moved toward the disengaged position, with the disengaged position being closer in proximity to the bar of the free weight than the engaged position;

a motor;

a transmission coupling the motor and the trigger handle to the spool, and to allow a movement of the trigger handle between the engaged and disengaged positions to override an action of the motor;

a height sensor;

a processor circuit coupled to the motor and the height sensor; and a storage to store a control routine comprising instructions that when executed by the processor circuit, causes the processor circuit to:

receive a command from a lifter to adjust a vertical height of the free weight to a specified height;

operate the height sensor to determine a difference between a current height of the free weight and the specified height; and operate the motor to change the vertical height of the free weight to the specified height.

16. The exercise weight support device of claim 15, the processor circuit further caused to:

receive the command from a manually-operable control carried by the frame and coupled to the processor circuit or from another device via a network interface coupled to the processor circuit; and receive the specified height with the command or retrieve the specified height from lifter data stored in the storage, the lifter data correlated to an identity of the lifter received by the processor circuit with the command.

17. An exercise weight support device comprising:

a pair of identically configured hooks formed integrally with a frame to support a bar of a free weight inserted into interior areas defined by each of the pair of hooks when the frame is suspended from an overhanging support structure by an upper end region of a belt;

a retracting reel mechanism co-located with the pair of hooks on the frame, the retracting reel mechanism to retract the belt starting at a lower end region of the belt to take up slack in the belt;

a trigger handle co-located with and connected to the retracting reel mechanism, and movable between a disengaged position in contact with the bar of the free weight and an engaged position away from the bar of the free weight, wherein:

movement of the trigger handle to the engaged position triggers the retracting reel mechanism prevent paying out of the belt to prevent lowering of the free weight;

movement of the trigger handle to the disengaged position causes the retracting reel mechanism to allow either retraction or paying out of the belt to allow the free weight to be raised or lowered;

the trigger handle is biased to move from the disengaged position to the engaged position to prevent the free weight from lowering under the weight thereof when a hand of a lifter lets go of the trigger handle while lifting the free weight; and a cradle extending between the pair of identically configured hooks, and having a curved cross-section that defines a concave surface that defines a trough in which the bar of the free weight is seated when the bar is inserted into the interior areas defined by each of the pair of hooks, and that defines a convex surface that mimics a portion of a curved surface of the bar of the free weight to enable a palm and inner surfaces of fingers of the hand to wrap around the combination of the cradle and the bar of the free weight, and to enable the lifter to lift the free weight by pressing upwardly against the convex surface of the cradle when the frame is suspended from the overhanging support structure by the belt.

18. The exercise weight support device of claim 17, wherein:

the trigger handle is slidable between the engaged and disengaged positions;

the cradle engages the bar of the free weight from beneath the bar, and the trigger handle is positioned above the bar when the frame is suspended from the overhanging support structure by the belt and the bar is seated within the trough defined by the cradle; and movement of the trigger handle from the engaged position to the disengaged position includes pulling the trigger handle in a downward sliding motion into contact with the bar of the free weight such that the bar of the free weight becomes sandwiched between the cradle and the trigger handle when the frame is suspended from the overhanging support structure by the belt, and when the bar of the free weight is seated in the trough.

19. The exercise weight support device of claim 17, wherein:

the trigger handle is connected to a pawl that is movable with the handle between the engaged and disengaged positions;

movement of the trigger handle to the engaged position moves the pawl into engagement with teeth of a ratchet wheel of the retracting reel mechanism to prevent paying out of the belt to prevent lowering of the free weight when the frame is suspended from the overhanging support structure by the belt; and movement of the trigger handle to the disengaged position moves the pawl away from the ratchet wheel to allow either retraction or paying out of the belt to allow the free weight to be raised or lowered when the frame is suspended from the overhanging support structure by the belt.

20. The exercise weight support device of claim 17, wherein:

the retracting reel mechanism comprises a brake connected to the trigger handle;

movement of the trigger handle to the engaged position triggers the brake to engage to prevent retraction or paying out of the belt to prevent raising or lowering of the free weight when the frame is suspended from the overhanging support structure by the belt; and movement of the trigger handle to the disengaged position triggers the brake to disengage to allow retraction or paying out of the belt to allow the free weight to be raised or lowered when the frame is suspended from the overhanging support structure by the belt.

* * * * *